United States Patent [19]

Gartland, Jr.

[11] 4,003,622

[45] Jan. 18, 1977

[54] LOCKING SHROUD FOR ELECTRICAL CONNECTOR

[75] Inventor: Albert J. Gartland, Jr., Trumbull, Conn.

[73] Assignee: Harvey Hubbell Incorporated, Orange, Conn.

[22] Filed: Feb. 17, 1976

[21] Appl. No.: 658,778

[52] U.S. Cl. ..... 339/75 P; 339/88 R

[51] Int. Cl.[2] ..... H01R 13/54

[58] Field of Search ..... 339/14 P, 75 P, 84, 339/88 R, 90 R, 91 R, 187

[56] References Cited

UNITED STATES PATENTS

| | | | |
|---|---|---|---|
| 2,923,909 | 2/1960 | Modrey | 339/90 R X |
| 2,968,017 | 1/1961 | Healy | 339/88 R |
| 3,393,395 | 7/1968 | Hubbell | 339/91 R |
| 3,945,702 | 3/1976 | Poliak et al. | 339/88 R |

FOREIGN PATENTS OR APPLICATIONS

| | | | |
|---|---|---|---|
| 2,322,626 | 11/1973 | Germany | 339/91 R |

*Primary Examiner*—Roy Lake
*Assistant Examiner*—E. F. Desmond
*Attorney, Agent, or Firm*—Jerry M. Presson

[57] ABSTRACT

An improved two-part electrical connector of the interlocking type. A generally cylindrical plug unit having a plurality of male electrical contacts extending from a front face thereof is provided. A generally cylindrical socket unit is adapted for mating with a plug unit. The socket unit has a front face with slots therein and a plurality of female electrical contacts beneath the slots to receive the male electrical contacts when the units are mated. The socket unit includes means for locking the plug and socket units against axial disengagement when the mated units are twisted with respect to one another. A generally cylindrical plug shroud element is mounted coaxially on the plug unit and a generally cylindrical socket shroud element is mounted coaxially on the socket unit and conforms circumferentially with the plug shroud element. Finally, manually actuable means are mounted in one of the shroud elements and movable to engage the other of the shroud elements to prevent relative rotation as between the plug and socket units on their common axis. In this manner, the plug and socket units are safely locked and cannot be accidentally disengaged. In the preferred embodiment of the invention the plug shroud element extends to at least the end of the male electrical contacts and serves to protect these contacts against damage. In this embodiment, the manually actuable means comprises a key mounted in a keyway in one of the shroud elements, and a keyway is also provided in the other of the shroud element. The key is slidable to engage both keyways simultaneously to effect the desired locking.

10 Claims, 4 Drawing Figures

LOCKING SHROUD FOR ELECTRICAL CONNECTOR

BACKGROUND OF THE INVENTION

This invention relates to two-part electrical cable connectors and, more particularly, to such connectors of the interlocking type.

Two-part interlocking electrical cable connectors are in widespread use. These devices generally consist of a socket part which contains female electrical contacts and a plug part which has male electrical contact blades that extend therefrom and are inserted into the female contacts when the parts are mated. In one type of connector, the male contact blades are generally L-shaped with a laterally projecting lug at the end of each blade. The body of the socket part has a front face with slots for receiving the male contact blades. When the connector parts are mated the male contact blades are inserted in the slots and the two connector parts are then axially rotated with respect to one another. Electrical contact is made and, also, the lug portion is moved, by virtue of the rotating action, to a position behind the front plate of the socket part. Since the lugs on the male contact blades are no longer aligned with the slots in the front plate of the socket part, the connector parts are locked together and not separable unless returned to their original relative rotational positions.

While the above-described type of interlocking electrical connectors generally function satisfactorily, there are some applications where the connector, or the cables which it connects, are subject to a relative rotational action or to vibration which can result in some relative rotation as between the plug and socket parts of the connector. If external forces untwist the connector parts, they are vulnerable to undesirable partial or complete separation which may cause a safety hazard or a power failure.

Electrical connectors, including those of the type described above, are sometimes provided with a cover or shield to protect the mated connector from damage caused by its environment. Some types of shields or covers involve separate structures which must be assembled and/or disassembled when using the connector, and these are inconvenient to use and are subject to being misplaced or lost. Other types of protective parts are found to be effective only when the connector parts are mated but do not, for example, protect the male contact blades when the connector parts are separate. A further limiting factor has been that the provision for a protective cover or shield may, of necessity, render the connector unduly cumbersome, complex, or expensive, or may spatially interfere with a locking mechanism or its operation.

A further consideration herein is as follows:
In addition to the objective of providing a novel connector device which is responsive to the prior art problems as set forth, it would be particularly desirable to provide a structure which could be used to inexpensively and advantageously modify existing connectors.

It is an object of the invention to provide a device which is responsive to the prior art problems as set forth.

SUMMARY OF THE INVENTION

The present invention is directed to an improved two-part electrical connector of the interlocking type.

A generally cylindrical plug unit having a plurality of male electrical contacts extending from a front face thereof is provided. A generally cylindrical socket unit is adapted for mating with a plug unit. The socket unit has a front face with slots therein and a plurality of female electrical contacts beneath the slots to receive the male electrical contacts when the units are mated. The socket unit includes means for locking the plug and socket units against axial disengagement when the mated units are rotated with respect to one another. A generally cylindrical plug shroud element is mounted coaxially on the plug unit and a generally cylindrical socket shroud element is mounted coaxially on the socket unit and conforms circumferentially with the plug shroud element. Finally, manually actuable means are mounted in one of the shroud elements and movable to engage the other of the shroud elements to prevent relative rotation as between the plug and socket units on their common axis. In this manner, the plug and socket units are safety locked and cannot be accidentially disengaged.

In the preferred embodiment of the invention the plug shroud element extends to at least the end of the male electrical contacts and serves to protect these contacts against damage. In this embodiment, the manually actuable means comprises a key mounted in a keyway in one of the shroud elements, and a keyway is also provided in the other of the shroud elements. The key is slideable to engage both keyways simultaneously to effect the desired locking.

In the preferred form of the invention each shroud element has an annular ring protruding from the inner surface thereof such that each shroud element is readily mountable on presently available connector units of the type to be described.

Further features and advantages of the invention will become more readily apparent from the following detailed description when taken in conjunction with the accompanying drawings.

DESCRIPTION OF THE PREFERRED EMBODIMENT

Figure 1:
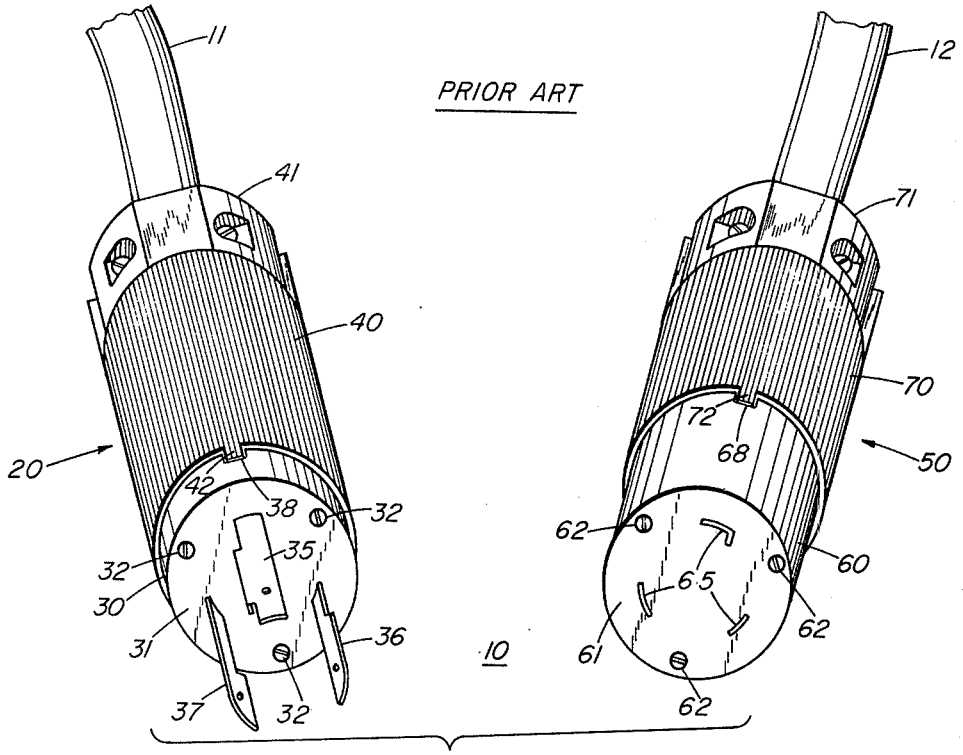
FIG. 1 is an elevational perspective view of a prior art two-part electrical connector.

Referring to FIG. 1 there is shown a prior art two-part electrical connector 10 of the type manufactured by Harvey Hubbell, Inc. of Bridgeport, Connecticut and sold under the trademark "TWIST-LOCK." A cap or plug unit 20 includes a plug head 30 and a plug base 40, these elements also being commonly known as a "blade holder" (30) and a "cover" (40). A connector or socket unit 50, adapted for mating with a plug unit 20, includes a socket head 60 and a socket base 70.

The plug head 30 has a generally cylindrical body formed of insulating material such as molded plastic, the body having a planar front face 31 with male electrical contacts or blades, 35–37, imbedded therein and extending therefrom. The plug base 40 is generally cylindrical in shape and has a front end which is removably secured to the rear end of the head 30 by screws 32 which are seated in threaded receptacles (not shown) in the base 40. The base 40 has a cable clamp 41 that secures a cable 11 which feeds through base 40 to the head 30 wherein the conductors are connectable, in conventional manner, to the electrical contact blades 35–37. The base 40 has a small tab 42 which fits into slot 38 in the head 30 and facilitates alignment of the head and base.

The socket head 50 also has a generally cylindrical body, formed of insulating material, the body having a planar front face 61 having slots 65 therein for insertion of the blades 35–37. A plurality of female electrical contacts (not shown) beneath the slots receive the contact blades when the units are mated. The socket base 70 is also generally cylindrical in shape and has a front end which is removably secured to the rear end of the head 60 by screws 62 which are seated in threaded receptacles (not shown) in the base 70. The base 70 has cable clamp 71 that secures a cable 12 which feeds through base 70 to the head 60 wherein the conductors are connectable, in conventional manner, to the female electrical contacts. The base 70 has a small tab 72 which fits into a slot 68 in the head 60 and facilitates alignment of the head and base.

The blades 35–37 are of the interlocking type and are of generally L-shaped construction with laterally projecting lugs, each of which defines an inwardly facing shoulder. When the plug and socket units are mated and then twisted or rotated on their common axis with respect to one another, the shoulders of the blades engage the inner surface of the front face 61. This prevents the separation of the units unless they are respectively rotated on the common axis to the original rotational orientations they had had before twisting.

Figure 2:
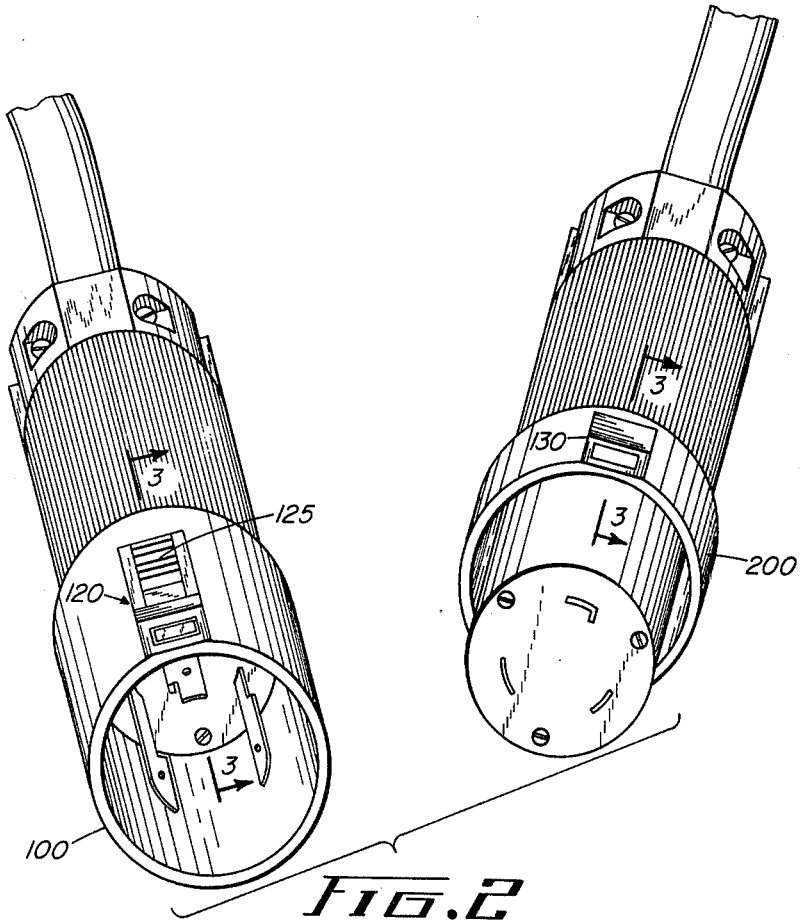
FIG. 2 is an elevational perspective view of an electrical connector of the type shown in FIG. 1 as modified in accordance with an embodiment of the present invention.

Referring to FIG. 2, there is shown the two-part electrical connector of FIG. 1 as modified in accordance with the present invention. The plug unit 20 has a plug shroud element 100, which may be formed of molded plastic, mounted coaxially thereon and extending past the front face thereof. The shroud element 100 has a keyway 120 mounted on the front edge thereof and a key 125 which is axially slideable in the keyway 120. A generally cylindrical socket shroud element 200, which may also be formed of plastic, is mounted coaxially on the socket unit 30, the shroud element 200 conforming circumferentially with the plug shroud element 100. A keyway 130 is mounted on the periphery of element 200 at the front edge thereof.

Figure 3:
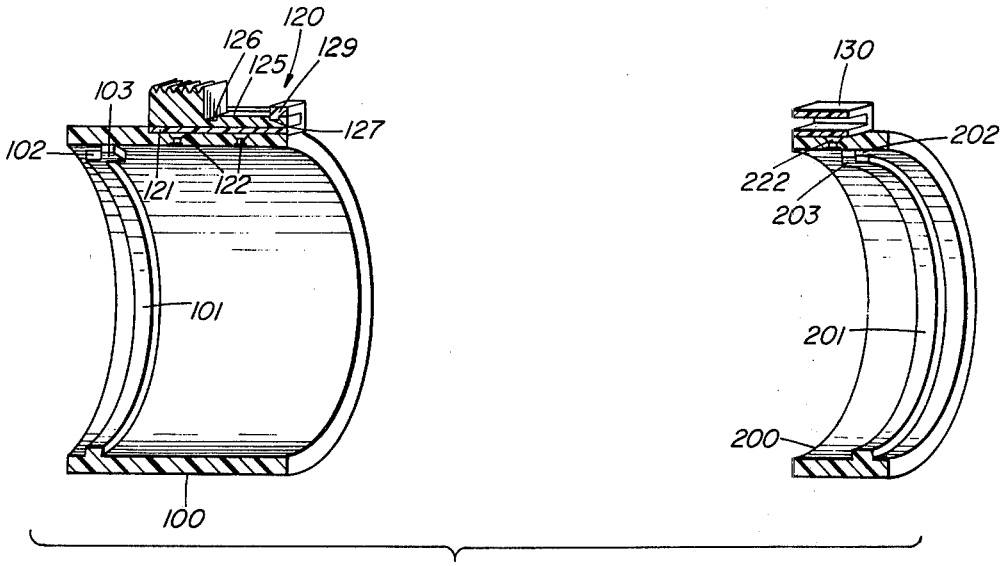
FIG. 3 is a perspective cross-sectional view of the shroud elements 100 and 200 of FIG. 2 as taken through sections defined by the arrows 3-3 of FIG. 2.

The manner of mounting the shroud elements and their operation can be more clearly understood with reference to FIG. 3. The plug shroud element 100 has an annular ring 101 protruding from the inner surface thereof. The ring 101 has a slot therein at 102 and a frontwardly protruding tab 103 in registration with the position of the slot 102. The plug shroud element 100 can thus be mounted on the plug unit 20 by removing screws 32 to separate the plug head 30 from the plug base 40, and then mounting the shroud element 100 on the plug base 40 and replacing the plug head and the screws. The annular ring 101 will be retained between the front end of the plug base and the rear end of the plug head. The tab 42 of the plug base (FIG. 1) fits into the slot 102 in the annular ring and the tab 103 of the annular ring fits into the slot 38 in the plug head 30 so that all parts are properly aligned. In the present embodiment the keyway 120 comprises a track 121 which is secured to the cylindrical body of shroud element 100 by a pair of rivets 122, although the keyway could, if desired, be molded integrally as part of the shroud element 100. The key 125 is insertible in the keyway 120 and is normally permanently retained therein. The rear of the key 125 has a serrated protrusion to facilitate actuation by a finger or thumb. The key body has a pair of detents 126 and 127 which engage a front top rim 129 of the keyway 120 and respectively define the forward and rearward positions of the key 125.

The socket shroud element 200 has an annular ring 201 protruding from the inner surface thereof. The ring 201 has a slot therein at 202 and a frontwardly protruding tab 203 in registration with the position of the slot 202. The socket shroud element 200 is therefore mountable on the socket unit 50 in the same manner as described in conjunction with the plug unit 20, with the tab 72 of the socket base (FIG. 1) fitting into the slot 202 of the annular ring and the tab 203 of the annular ring fitting into the slot 68 in the socket head 60 so that all parts are properly aligned. The keyway 130 is secured to the cylindrical body of shroud element 200 by a pair of rivets 222, although the keyway could, if desired, be molded integrally as part of the shroud element 200.

Figure 4:
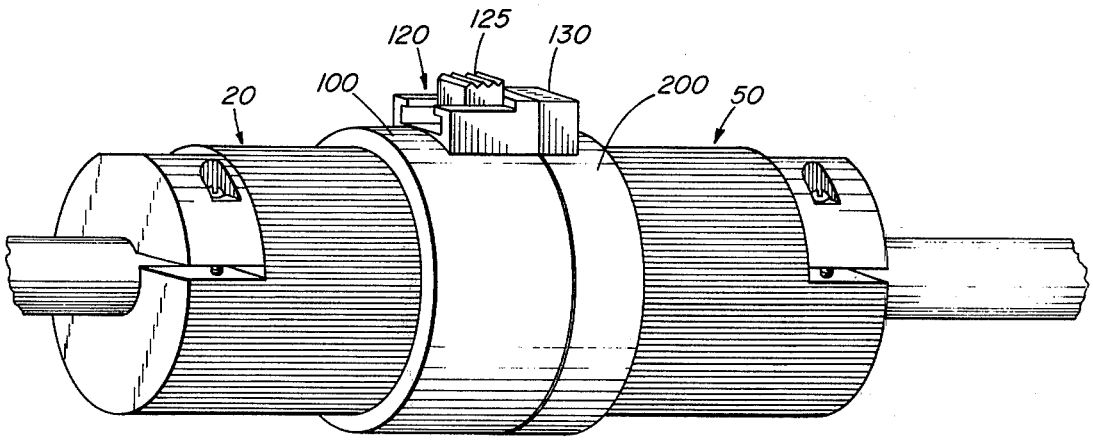
FIG. 4 is an elevational perspective view showing the plug and socket units of FIG. 2 after they have been mated and their shroud elements locked.

FIG. 4 shows the electrical connectors of FIG. 2 after they have been mated, twisted for locking, and the key 125 forwardly positioned so as to engage the keyway 130 to lock the shroud elements 100 and 200 against relative rotation.

The invention has been described with reference to a preferred embodiment, but variations within the spirit and scope of the invention will occur to those skilled in the art. For example, the plug shroud element preferably extends to at least the end of the blades 35-37 to provide protection during a partial or complete disconnect. However, it will be appreciated that a shorter plug shroud element could be utilized in conjunction with a longer socket shroud element so that both have the same length. In such case, an advantage would be that the two basic shroud elements would be identical, except for the key, and could be formed in a single molding operation.

I claim:

1. A two-part electrical connector, comprising:

a plug unit having a plurality of male electrical contacts extending from a front face thereof;

a socket unit adapted for mating with said plug unit, said socket unit having a front face with slots therein and a plurality of female electrical contacts beneath said slots to receive the male electrical contacts when the units are mated;

said socket unit including means for locking said plug and socket units against axial disengagement when the mated units are rotated with respect to one another;

a generally cylindrical plug shroud element mounted coaxially on said plug unit;

a generally cylindrical socket shroud element mounted coaxially on said socket unit and conforming circumferentially with said plug shroud element; and manually actuable means mounted in one of said shroud elements and moveable to engage the other of said shroud elements to prevent relative rotation as between said plug and socket units on their common axis.

2. The electrical connector as defined by claim 1 wherein said manually actuable means comprises a key mounted in a keyway in one of said shroud elements and further comprising a keyway in the other of said shroud elements, said key being slideable to engage both keyways simultaneously.

3. The connector as defined by claim 1 wherein said plug shroud element extends to at least the end of said male electrical contacts.

4. The connector as defined by claim 2 wherein said plug shroud element extends to at least the end of said male electrical contacts.

5. For use in conjunction with a two-part electrical connector including a plug unit which comprises a generally cylindrical plug head having a plurality of male contacts extending from the front face thereof and a generally cylindrical plug base having a front end removably secured to the rear end of said plug head, and a socket unit adapted for mating with said plug unit which comprises a generally cylindrical socket head having a front face with slots therein and a plurality of female contacts beneath said slots to receive the male contacts when the units are mated and a generally cylindrical socket base having a front end removably secured to the rear end of said socket head, said electrical connector including means for locking said plug and socket units against axial disengagement when the mated units are rotated with respect to one another, a protective device comprising:

a plug shroud element having a hollow generally cylindrical shape and an annular ring protruding from the inner surface thereof, said plug shroud element being proportioned for coaxial mounting on said plug unit with its annular ring retained between the rear end of said plug head and the front end of said plug base, said plug shroud element extending past the front face of said plug head; and a socket shroud element having a hollow generally cylindrical shape and an annular ring protruding from the inner surface thereof, said socket shroud element being proportioned for coaxial mounting on said socket unit with its annular ring retained between the rear end of said socket head and the front end of said socket base; and manually actuable means mounted in one of said shroud elements and moveable to engage the other of said shroud elements to prevent relative rotation as between said plug and socket units on their common axis.

6. The device as defined by claim 5 wherein said manually actuable means comprises a key mounted in a keyway in one of said shroud elements and further comprising a keyway in the other of said shroud elements, said key being slidable to engage both keyways simultaneously.

7. The device as defined by claim 5 wherein said plug shroud element extends to at least the end of said male electrical contacts.

8. The device as defined by claim 6 wherein said plug shroud element extends to at least the end of said male electrical contacts.

9. The device as defined by claim 5 wherein the plug and socket bases have tabs at their front ends and the plug and socket heads have slots at their rear ends proportioned in accordance with the tabs, and wherein the annular rings in each of said shroud elements have a tab and slot proportioned to fit in the slot and tab, respectively, of their associated plug or socket unit.

10. The device as defined by claim 8 wherein the plug and socket bases have tabs at their front ends and the plug and socket heads have slots at their rear ends proportioned in accordance with the tabs, and wherein the annular rings in each of said shroud elements has a tab and slot proportioned to fit in the slot and tab, respectively, of their associated plug or socket unit.

* * * * *